United States Patent [19]

Ido

[11] Patent Number: 4,690,027

[45] Date of Patent: Sep. 1, 1987

[54] APPARATUS FOR FINE TUNING STRINGS OF A STRINGED MUSICAL INSTRUMENT

[76] Inventor: Nobuyuki Ido, 910-1, Osugi, Seki-shi, Gifu-ken, Japan

[21] Appl. No.: 844,402

[22] Filed: Mar. 26, 1986

[51] Int. Cl.[4] ..... G10D 3/04

[52] U.S. Cl. ..... 84/298; 84/313

[58] Field of Search ..... 84/297 R, 298, 299, 84/313

[56] References Cited

U.S. PATENT DOCUMENTS

| | | | |
|---|---|---|---|
| 2,969,703 | 1/1961 | Matteo | 84/299 |
| 4,457,201 | 7/1984 | Storey | 84/313 |
| 4,608,905 | 9/1986 | Takabayashi | 84/313 |

*Primary Examiner*—Lawrence R. Franklin

*Attorney, Agent, or Firm*—Jordan and Hamburg

[57] ABSTRACT

A fine tuning apparatus, for a stringed musical instrument, is constructed with: a base plate adapted to be attached to a body of the stringed musical instrument; a plurality of saddle plates mounted on the base plate; a pivotable saddle mounted on the respective saddle plate and having in its surface a groove for receiving the respective string; a string anchoring member mounted on each saddle plate rearwardly of the saddle, the anchoring member having an arm pivotable toward and away from the base plate and a hook connected to the arm and adapted to catch a ball attached to a rear end of the string, the hook being pivotable longitudinally of the string in response to pivoted movement of the arm; and a first adjusting means mounted on the arm of the anchoring member for adjusting the distance between the arm and the base plate to change the position of the hook and to thereby fine tune the string.

3 Claims, 8 Drawing Figures

APPARATUS FOR FINE TUNING STRINGS OF A STRINGED MUSICAL INSTRUMENT

BACKGROUND OF THE INVENTION

The present invention relates to an apparatus for fine tuning strings of a stringed musical instrument.

A typical example of such a fine tuning apparatus is shown in U.S. Pat. No. 4,497,236. In this known apparatus, as reillustrated here in FIG. 8 of the accompanying drawings, a tremolo base plate 7 is mounted on the body 3 of a guitar by a plurality of screws 12, there being a plurality of forward block members 41 each mounted on the tremolo base plate 7 by a screw 16 so as to be movable longitudinally of the respective string 100. A rear block member 42 is mounted on the rear side of each forward block member 41 by a pin 45 so as to be pivotable vertically. Each rear block member 42 has in its forward top surface a groove 43 for the respective string 100, and has rearwardly of the groove 43 an opening 44 in which a clamp 46 is disposed. A threaded shank 47 threadedly extends through a rear wall of the rear block member 42 for pushing the clamp 46 forwardly to clamp the rear end (from which a terminal ball 101 is removed by cutting) of the string 100 between the forward wall of the rear block member 42 and the clamp 46.

Each threaded shank 47 extends through a flange 48 projecting obliquely upwardly rearwardly from the rear end of the tremolo base plate 7 and terminating in a rearwardly directed horizontal portion into which a tuning finger screw 49 threadedly extends to abut against the threaded shank 47.

However, the prior art apparatus has a problem in that since the string 100 is tightly clamped between the forward wall of the rear block member 42 and the clamp 46 by tightening the threaded shank 47, the rear block member 42 and the clamp 46 need to have an adequate degree of hardness and therefore must be treated by hardening process. Also, this conventional construction requires a relatively large number of parts. Another problem of the prior apparatus is that the terminal ball 101 must be removed by cutting from the rear end of the string 100 before the latter is clamped, requiring a cutter. When cutting, the blade of the cutter can be easily broken. The fourth, fifth and sixth strings in particular, which are twisted strings, tend to become loose when cut to remove the respective terminal ball 101.

SUMMARY OF THE INVENTION

It is therefore an object of the present invention to provide an apparatus for fine tuning strings of a stringed musical instrument in which each string can be easily attached without the necessity of cutting off a terminal ball from the string.

Another object of the invention is to provide an apparatus for fine tuning strings of a stringed musical instrument in which a threaded shank and a clamp are not needed, thus not only reducing the number of parts, but also requiring no hardening process of such parts. Therefore this apparatus is easy to manufacture.

A further object of the invention is to provide an apparatus for fine tuning strings of a stringed musical instrument in which only a single kind of saddle is necessary, thus not requiring a plurality of kinds of saddles of different heights.

A still further object of the invention is to provide an apparatus for fine tuning strings of a stringed musical instrument in which even if the height of saddles become not suited to that of the neck of a guitar due to twist occurring as a result of long use of the guitar, the height of the saddles can be coordinated with the height of the neck, thus maintaining the strings in tune.

In order to accomplish the above objects, a fine tuning apparatus of the present invention comprises: a base plate adapted to be attached to a body of the stringed musical instrument; a plurality of saddle plates mounted on the base plate; a saddle mounted on each of the saddle plates and having in its surface a groove for receiving the respective string; a string anchoring member mounted on each saddle plate rearwardly of the saddle, the anchoring member having an arm pivotable toward and away from the base plate, and a hook connected to the arm and adapted to catch a terminal ball mounted on the rear end of the string, the hook being pivotable longitudinally of the string in response to the pivotal movement of the arm; and a first adjusting means mounted on the arm of each anchoring member for adjusting the distance between the arm and the base plate to change the position of the hook and hence to fine tune the string.

Other objects and advantages of the present invention will become apparent from the following description of an example of the invention, when considered in connection with the accompanying drawings.

DETAILED DESCRIPTION OF THE PREFERRED EMBODIMENTS

FIGS. 1 through 5 illustrate an electric guitar embodying the present invention, generally indicated by the numeral 1.

Figure 2:
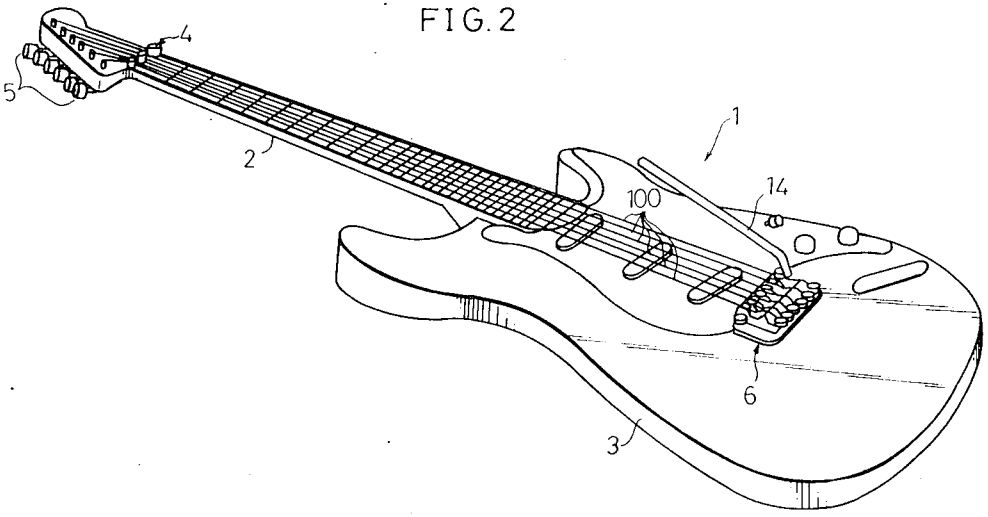
FIG. 2 is a perspective view of an electric guitar in which the fine tuning apparatus of FIG. 1 is incorporated.

As shown in FIG. 2, the electric guitar 1 comprises a neck 2 and a body 3. On the forward end of the neck 2, a plurality of strings 100 are supported and there a neck-side fine tuning apparatus 4 is mounted for tightening the strings 100 to fine tune the tension of the respective string 100. Also an adjusting peg 5 is mounted on the back side of the neck 2 for each string 100. Substantially centrally on the body 3, the strings 100 are also supported and there a bridge-side fine tuning apparatus 6 is mounted for fine tuning the tension of the respective string 100.

The bridge-side fine tuning apparatus 6 will be described hereinbelow in connection with FIGS. 1, 3 and 4 in particular.

On the guitar body 3 a planar tremolo base plate 7 is mounted. As shown in FIG. 4 in particular, the tremolo base plate 7 has in its forward opposite corners a pair of arcuate cutouts 8 through which a pair of screws 12 extend respectively to thereby secure the tremolo base plate 7 to the guitar body 3. The tremolo base plate 7 also has in its forward portion a pair of forward and rear rows of through-holes 9 and in its rear portion a plurality of longitudinally extending elongated through-holes 10. A block 13 is fixedly secured centrally to the bottom surface of the tremolo base plate 7 and extends toward the bottom side of the guitar body 3.

Figure 3:
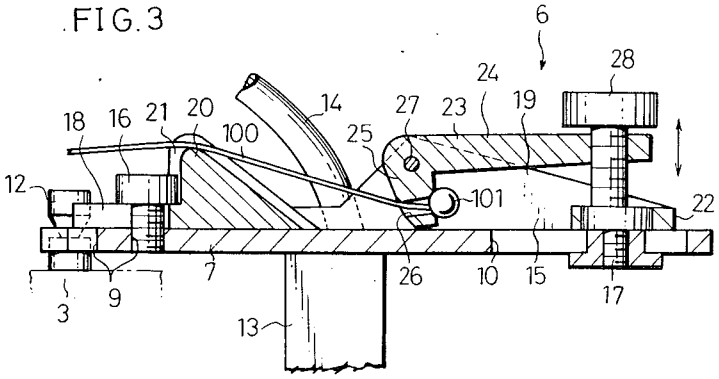
FIG. 3 is an enlarged cross-sectional view taken along the line III—III of FIG. 1.
Figure 4:
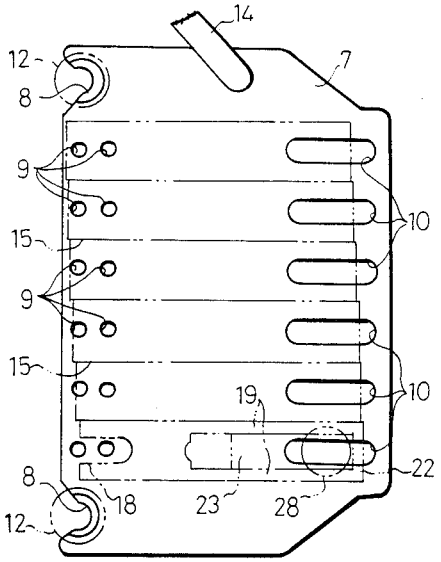
FIG. 4 is a plan view of the bridge-side fine tuning apparatus.

As shown in FIGS. 2, 3 and 4, a tremolo rod 14 is secured to a side edge portion of the tremolo base plate 7. When the tremolo rod 14 is pushed toward the guitar body 3, the tremolo base plate 7 is inclined in such a direction that its rear portion is angularly lifted from the guitar body 3 about the pair of screws 12.

A plurality of saddle plates 15 are secured to the top surface of the tremolo base plate 7 by a plurality of screws 16, 17 threadedly extending through the through-holes 9 and the elongated through-holes 10, respectively. By loosening these screws 16, 17, the individual saddle plate 15 can be moved longitudinally of the string 100 to adjust the tension of the string 100. Each saddle plate 15 has at its forward end a bifurcated portion 18 for receiving therethrough the screw 16, and at its rear end portion a pair of opposite side walls 19 in the form of a chevron. A saddle 20 is formed between the bifurcated portion 18 and the opposite side walls 19 of each saddle plate 15 integrally therewith and having a central longitudinal groove 21 receptive of the string 100. These saddles 20 have different heights so as to correspond to a laterally arcuate upper surface of the neck 2. The rear end of each saddle plate 15 constitutes a mounting portion 22 for receiving therein the screw 17.

Figure 1:
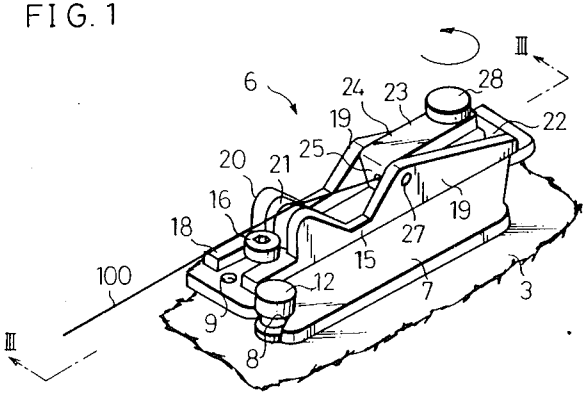
FIG. 1 is a fragmentary enlarged perspective view of a bridge-side fine tuning apparatus embodying the present invention.

As shown in FIGS. 1 and 3, a string anchoring member 23 is mounted between each pair of side walls 19. Each anchoring member 23 includes an arm 24 extending longitudinally of the string 100 and a hook 25 extending downwardly from the forward end of the arm 24, and is vertically pivotally supported on the opposite side walls 19 by a pin 27 extending through the joint of the arm 24 and the hook 25. A tuning finger screw 28, as a first adjusting means for fine tuning the tension of the string 100, extends threadedly through the rear end of the arm 24 of the anchoring member 23 from the top side thereof and terminates in a distal end abutting on the top of the screw 17. The hook 25 of each anchoring member 23 has an opening 26 for receiving therethrough the string 100. The size of the opening 26 is such that a terminal ball 101 of the string 100 is caught by the peripheral edge of the opening 26 when the string 100 is inserted therethrough. With the string 100 thus supported on the anchoring member 23, the anchoring member 23 is urged clockwise about the pin 27 under the tension of the string 100.

When each tuning finger screw 28 is turned in the direction of the arrow in FIG. 1, the arm 24 of the anchoring member 23 is lowered. Conversely, when the tuning finger screw 28 is turned in a direction opposite to the direction of the arrow in FIG. 1, the arm 24 of the anchoring member 23 is raised.

Figure 5:
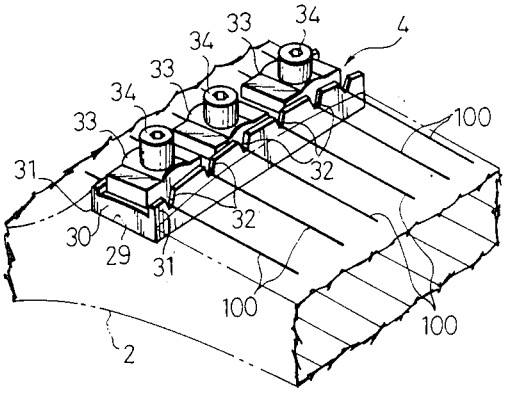
FIG. 5 is a perspective view of a neck-side fine tuning apparatus.

The neck-side fine tuning apparatus 4 will be described hereinbelow in connection with FIG. 5. The neck-side fine tuning apparatus 4 is mounted in a mounting recess 29 formed in the forward end portion of the neck 2. A base 30 of the neck-side fine tuning apparatus 4 has at its forward and rear sides a pair of upwardly projecting side walls 31, respectively, each side wall 31 having a plurality of grooves 32 for receiving the respective strings 100. A plurality of clamping blocks 33 are fixedly secured to the top surface of the base 30 by a plurality of screws 34, respectively, for clamping a pair of the strings 100 between the base 30 and opposite side portions of each clamping block 33.

To fine tune the tension of the individual string 100 in the electric guitar thus constructed, each tuning finger screw 28 is turned in the direction of the arrow or in a direction opposite thereto to move the arm 24 of each anchoring member 23 downwardly or upwardly, thus causing the hook 25 to move forwardly or rearwardly to adjust the string tension.

Figure 8:
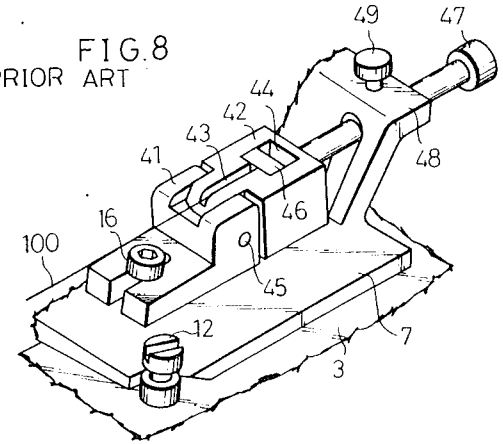
FIG. 8 PRIOR ART
FIG. 8 is a fragmentary perspective view of a conventional fine tuning apparatus.

In this embodiment, since the string 100 is attached to the anchoring member 23 by merely inserting the string 100 through the opening 26 of the anchoring member 23 until the terminal ball 101 is caught by the peripheral edge of the opening 26, easy mounting of the string 100 can be achieved without the necessity of cutting off the terminal ball 101 from the string 100, which is laborious and time-consuming. With this arrangement, a threaded shank and a clamp are not needed, reducing the number of parts and also requiring no hardening process of such parts. Therefore the apparatus 3 is easy to manufacture. Further, since the tremolo base plate 7 of the appratus 3, unlike the conventional tremolo base plate (FIG. 8), is in the form of a planar plate without any flange, it is easy to manufacture.

Because the neck-side fine tuning apparatus 4 is mounted in the mounting recess 29 of the neck 2 rather than fastened by means of screws vertically extending through the neck 2, there is no danger that the neck 2 could be weakened at the portion where the neck-side fine tuning apparatus 4 is mounted. Therefore, even if the guitar is used for a long period of time, the neck 2 will not be broken at the portion where the neck-side fine tuning apparatus 4 is mounted.

Figure 7:
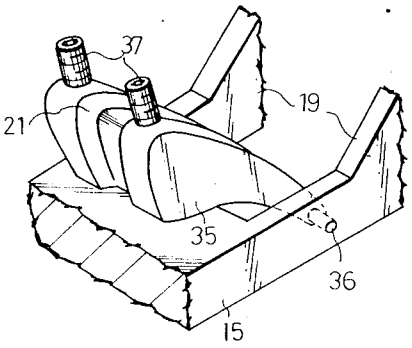
FIG. 7 is a fragmentary perspective view of FIG. 6, illustrating the manner in which saddles are mounted.
Figure 6:
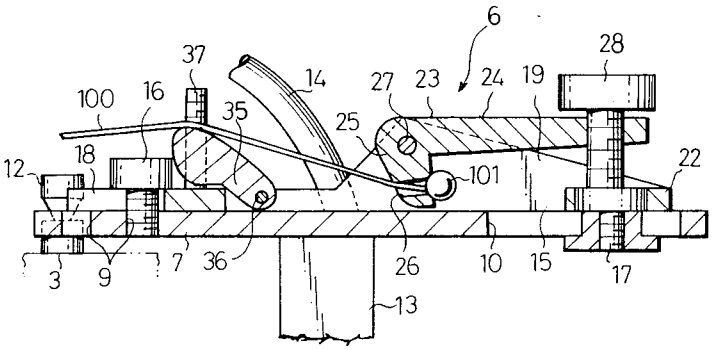
FIG. 6 is a cross-sectional view similar to FIG. 3, but showing a modification of the bridge-side fine tuning apparatus.

FIGS. 6 and 7 illustrate a modified bridge-side fine tuning apparatus 6. In this embodiment, each saddle 35 is separate from the saddle plate 15 and is vertically pivotally mounted between each pair of the side walls 19 by a pin 36 extending through a base of the saddle 35. A pair of screws 37, as a second adjusting means for fine tuning the string 100, threadedly extends through opposite side portions of each saddle 35 from its top and each terminates in a distal end abutting on the saddle plate 15. By turning these screws 37, the height of the individual saddles 35 can be adjusted.

In the embodiment of FIGS. 6 and 7, unlike the preceding embodiment, because the height of each saddle 35 can be varied by turning each screw 37, only a single kind of saddle is needed, thus not requiring various kinds of saddles of different heights.

In the event that the height of each saddle 35 became not suited to the level or height of the upper surface of the neck 2 when the latter is twisted as a result of long use of the guitar 1, the height of each saddle 35 can be varied by the screw 37 so as to be coordinated with the twist of the neck 2, thus maintaining the strings in proper tune.

In the illustrated embodiments, the present invention is applied to an electric guitar. However, it may be applied to any other stringed musical instrument, such as a cello, a banjo, or a piano.

As mentioned above, since the string is attached to the anchoring member by merely inserting the string through the opening of the anchoring member until the terminal ball is caught by the peripheral edge of the opening, easy mounting of the string can be achieved without the necessity of cutting off the terminal ball from the string, which is laborious and time-consuming. With this arrangement, unlike the conventional construction, a threaded shank and a clamp are not needed, reducing the number of parts and also requiring no hardening process for such parts. Therefore, the apparatus is easy to manufacture.

Although preferred embodiments of the present invention have been disclosed herein for purposes of illustration, it should be understood that various changes, modifications and substitutions may be incorporated in such embodiments without departing from the spirit of the invention.

What is claimed is:

1. An apparatus for fine tuning a plurality of strings of a stringed musical instrument, comprising:

(a) a base plate adapted to be attached to a body of the stringed musical instrument;

(b) a plurality of saddle plates mounted on said base plate;

(c) a string anchoring member on each said saddle plate, each said anchoring member having an arm pivotable toward and away from said base plate and a hook extending from said arm and adapted to catch a terminal ball disposed on a rear end of a respective string, said hook being pivotable longitudinally of the respective string in response to pivotal movement of said arm;

(d) first adjusting means mounted on said arm of each said anchoring member for adjusting a distance between said arm and said base plate to change the position of said hook to fine tune the respective string;

(e) first and second side walls respectively disposed at first and second sides of each said anchoring member;

(f) a saddle mounted separately on each of said saddle plates in front of said anchoring member, said saddle having a base portion and having opposite first and second side portions with a groove formed therebetween for receiving a respective string; and (g) a pin provided on each of said first and second side walls for supporting said base portion of said saddle for pivoting said saddle on said saddle plate toward and away from said base plate.

2. An apparatus according to claim 1, wherein each said saddle is provided with a second adjusting means for adjusting a distance between a distal end of said saddle and said saddle plate to thereby fine tune the respective string.

3. An apparatus according to claim 2, wherein said second adjusting means comprises first and second screws threadedly extending respectively through each of said first and second side portions of said saddle, each of said first and second screws having a distal end abutting on a respective one of said saddle plates.

* * * * *